US009250584B1

(12) United States Patent
Okano et al.

(10) Patent No.: US 9,250,584 B1
(45) Date of Patent: Feb. 2, 2016

(54) FIXER THAT FORMS A NIP WITH AN INDUCTION-HEATED BELT AND AN IMAGE FORMING APPARATUS HAVING THE SAME

(71) Applicants: KABUSHIKI KAISHA TOSHIBA, Tokyo (JP); TOSHIBA TEC KABUSHIKI KAISHA, Tokyo (JP)

(72) Inventors: Yoshiaki Okano, Mishima Shizuoka (JP); Satoshi Itaya, Mishima Shizuoka (JP); Yoshiki Kogiso, Mishima Shizuoka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/625,157

(22) Filed: Feb. 18, 2015

(51) Int. Cl.
*G03G 15/20* (2006.01)

(52) U.S. Cl.
CPC ..... *G03G 15/2053* (2013.01)

(58) Field of Classification Search
CPC ..... G03G 15/2053
USPC ..... 399/329
See application file for complete search history.

(56) References Cited

U.S. PATENT DOCUMENTS

| | | | | |
|---|---|---|---|---|
| 2004/0136761 | A1* | 7/2004 | Asakura et al. | 399/328 |
| 2012/0121302 | A1* | 5/2012 | Nakayama et al. | 399/329 |
| 2012/0263510 | A1* | 10/2012 | Mita et al. | 399/329 |
| 2013/0195522 | A1* | 8/2013 | Kasama | 399/329 |
| 2014/0294466 | A1* | 10/2014 | Matsuno | 399/329 |

OTHER PUBLICATIONS

U.S. Appl. No. 14/285,695, filed May 23, 2014.

* cited by examiner

*Primary Examiner* — Susan Lee
(74) *Attorney, Agent, or Firm* — Patterson & Sheridan, LLP

(57) ABSTRACT

A fixer includes a fixing belt configured to move around a center, a heating unit configured to induction-heat the fixing belt, a pressing member that presses an outer surface of the fixing belt, a resilient member disposed opposite to the pressing member across the fixing belt, and a heat generating member that is capable of being induction-heated and disposed along the inner surface of the fixing belt between a first position and a second position that is downstream with respect to the first position in a moving direction of the fixing belt. An upstream end portion of the resilient member in the moving direction is in contact with a third position of the fixing belt, and an angle formed with respect to the center by the second and third positions is equal to or smaller than 60°.

20 Claims, 7 Drawing Sheets

FIG. 7

| ANGLE θ (degree) | LIFE DURATION OF FIXING BELT (NUMBER OF SHEETS) |
|---|---|
| 100° | 7K SHEETS |
| 80° | 21K SHEETS |
| 60° | GREATER THAN 200K SHEETS |
| 40° | GREATER THAN 200K SHEETS |
| 20° | GREATER THAN 200K SHEETS |

FIXER THAT FORMS A NIP WITH AN INDUCTION-HEATED BELT AND AN IMAGE FORMING APPARATUS HAVING THE SAME

FIELD

Embodiments described herein relate generally to a fixer and an image forming apparatus.

BACKGROUND

In one type of a fixer that is used to fix an image on a sheet, electromagnetic induction heating (IH) is employed to heat a fixing belt using a magnetic flux from an exciting coil. The fixer of this type typically includes the fixing belt, a pressing member, a fixing pad, a heat generating element, and an exciting coil. The fixing pad is urged towards an inner surface of the fixing belt to form a nip, and the heat generating element, which is disposed along the inner surface of the fixing belt, generates heat through the electromagnetic induction heating. However, a crack may be produced in a layer of the fixing belt while the fixer is used. As a result, the fixing belt having the crack may have a region that cannot generate sufficient amount of heat to fix the image. Further, another region of the cracked fixing belt may generate excessive amount of heat, and, as a result, the fixing belt may be damaged.

DESCRIPTION OF THE DRAWINGS

FIG. 7 illustrates a relationship between a central angle of an arc where the heat generating member is not formed and life duration of the fixing belt.

DETAILED DESCRIPTION

Figure 1:
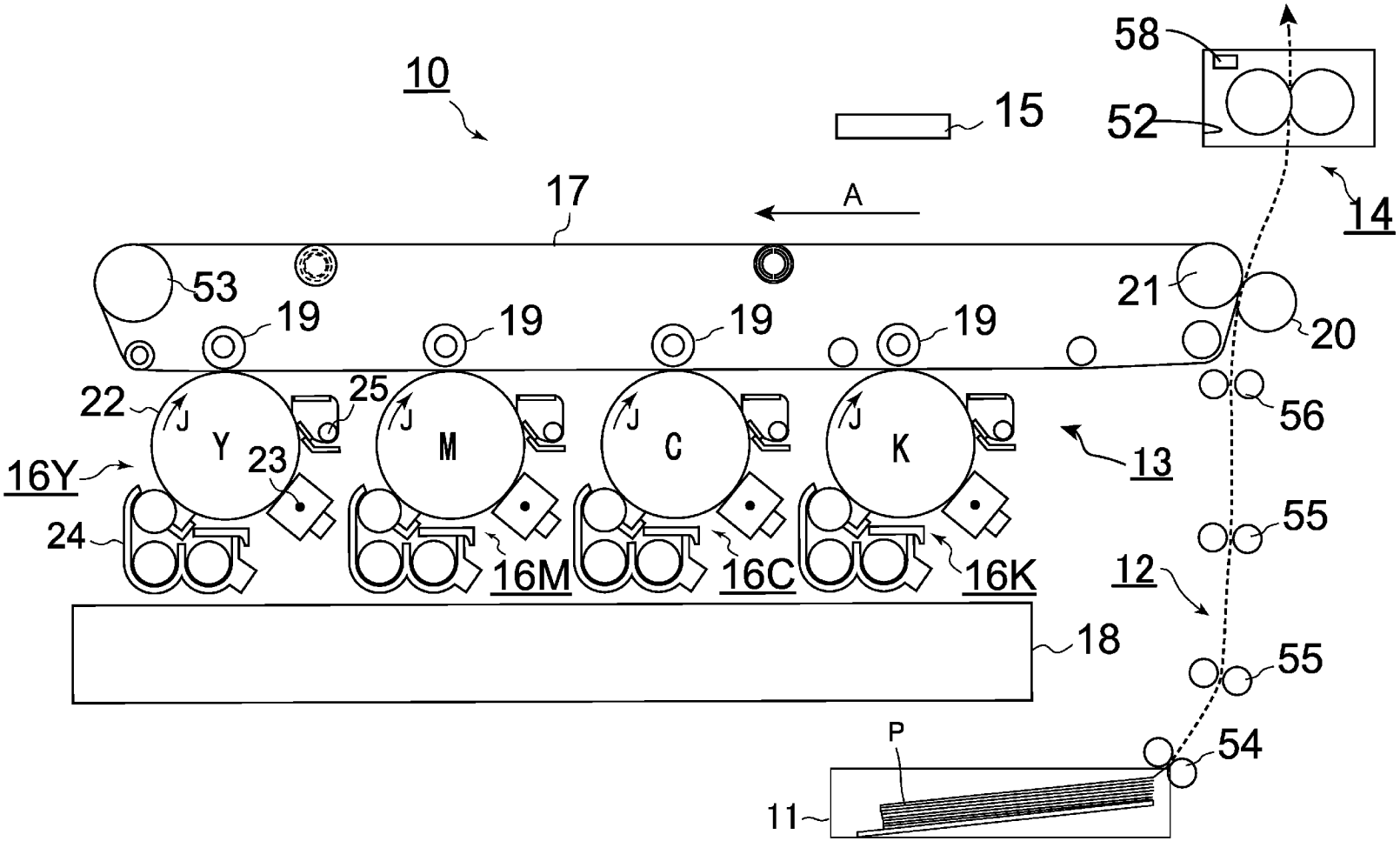
FIG. 1 illustrates an image forming apparatus according to one embodiment.

According to one or more embodiments, a fixer includes a fixing belt configured to move around a center, a heating unit configured to induction-heat the fixing belt, a pressing member that presses an outer surface of the fixing belt, a resilient member disposed opposite to the pressing member across the fixing belt, and a heat generating member that is capable of being induction-heated and disposed along the inner surface of the fixing belt between a first position and a second position that is downstream with respect to the first position in a moving direction of the fixing belt. An upstream end portion of the resilient member in the moving direction is in contact with a third position of the fixing belt, and an angle formed with respect to the center by the second and third positions is equal to or smaller than 60°.

According to one or more embodiments, an image forming apparatus includes an image forming unit configured to form a toner image on a sheet and a fixing unit configured to fix the toner image on the sheet. The fixing unit includes a fixing belt configured to move around a center, a heating unit configured to induction-heat the fixing belt, a pressing member that presses an outer surface of the fixing belt, a resilient member disposed opposite to the pressing member across the fixing belt and urged towards an inner surface of the fixing belt, and a heat generating member that is capable of being induction-heated and disposed along the inner surface of the fixing belt between a first position and a second position that is downstream with respect to the first position in a moving direction of the fixing belt. An upstream end portion of the resilient member in the moving direction is in contact with a third position of the fixing belt, and an angle formed with respect to the center by the second and third positions is equal to or smaller than 60°.

Throughout this description, the embodiments and examples shown should be considered as exemplars, rather than limitations on the apparatus and methods of the present invention.

Hereinafter, the fixer and the image forming apparatus will be described in detail using accompanying drawings as examples. In addition, the same element or the same portion in each figure will be given the same reference numeral, and redundant descriptions thereof will be omitted.

FIG. 1 illustrates an image forming apparatus according to an embodiment.

A multi functional peripheral (MFP) 10 includes a cassette 11, a sheet feeding unit (sheet feeding device) 12, a printing unit 13, and a fixer (fixing unit) 14.

The cassette 11 stores a bundle of sheets P. The sheet feeding unit 12 sends each of the sheets P (printing medium) to the printing unit 13.

The printing unit 13 includes a yellow station 16Y, a magenta station 16M, a cyan station 16C, and a black station 16K.

The printing unit 13 further includes an intermediate transfer belt 17, an exposure unit 18, four primary transfer rollers 19, a secondary transfer roller 20, and a counter roller 21.

The yellow station 16Y is an image forming processing unit (image forming unit) for Y (yellow), and includes a photosensitive drum 22, a charger 23, a developing unit 24, and a photoreceptor cleaner 25.

The photosensitive drum 22 rotates in a direction of an arrow J. The charger 23 is a unit for charging, and charges the outer surface of the photosensitive drum 22. The photosensitive drum 22 forms an electrostatic latent image on the outer surface of the photosensitive drum 22.

The developing unit 24 visualizes the electrostatic latent image with toner. The photoreceptor cleaner 25 cleans toner which is left on the photosensitive drum 22.

The magenta station 16M is an image forming processing unit for M (magenta). The cyan station 16C is an image forming processing unit for C (cyan). The black station 16K is an image forming processing unit for K (black).

All of the magenta station 16M, the cyan station 16C, and the black station 16K have substantially the same configuration as the yellow station 16Y.

The intermediate transfer belt 17 endlessly moves in a direction of an arrow A in accordance with the rotation of the counter roller 21 or a roller 53. A tension is applied to the intermediate transfer belt 17.

The exposure unit 18 radiates laser light towards the yellow station 16Y, the magenta station 16M, the cyan station 16C, and the black station 16K, respectively.

Each primary transfer roller 19 causes the intermediate transfer belt 17 to be in contact with a corresponding photosensitive drum 22 while being urged downward. The intermediate transfer belt 17 and a sheet are nipped between the secondary transfer roller 20 and the counter roller 21.

Figure 2:
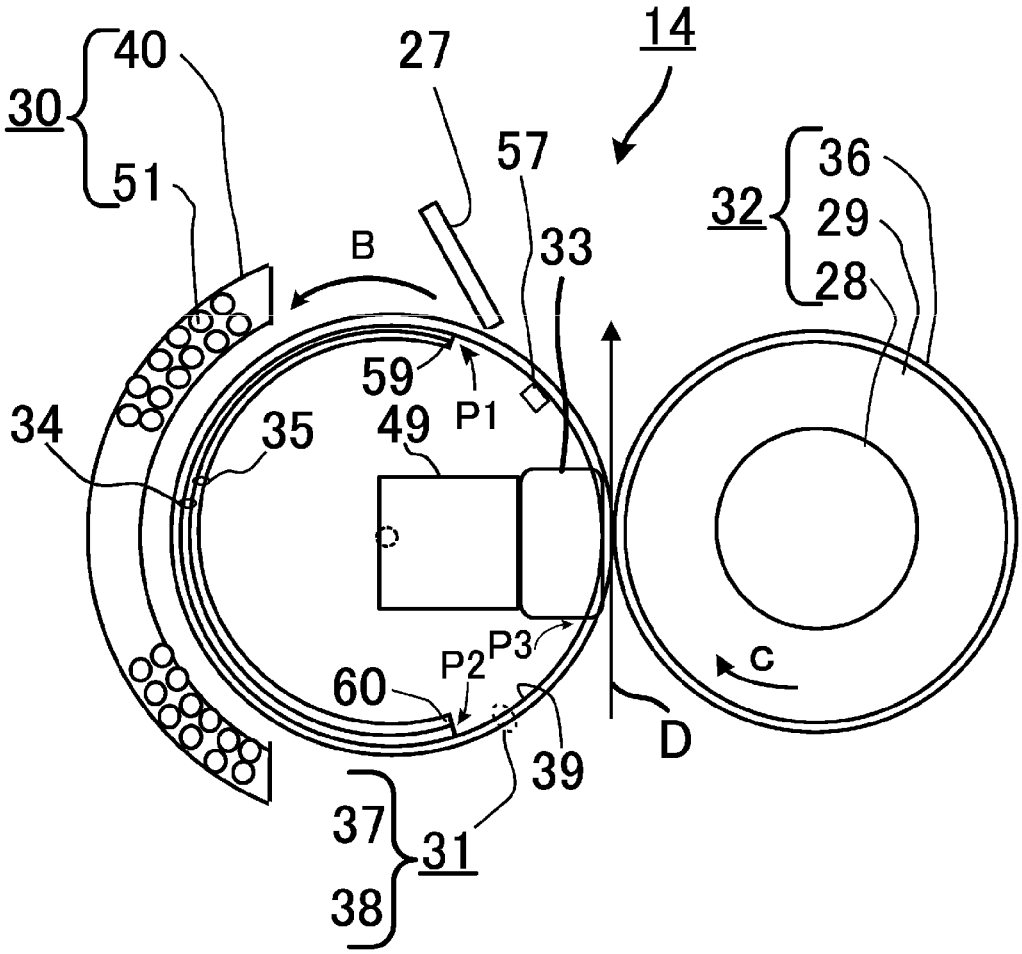
FIG. 2 illustrates a fixer according to the embodiment.

FIG. 2 illustrates the fixer 14.

The fixer 14 causes a toner image to be fixed on a sheet which is sent in a sheet transport direction (direction of arrow D) using an endless fixing belt 31 which rotates in one direction (direction of arrow B), and a pressurizing roller 32 which rotates in one direction (direction of arrow C).

The fixer 14 includes an exciting coil 30 which generates a magnetic flux, and the fixing belt 31 that has a belt width, is provided so as to move in the arrow B, and is subjected to induction heating due to the magnetic flux generated by the exciting coil 30.

In addition, the fixer 14 includes the pressurizing roller 32 (pressing member) which faces the fixing belt 31, and a fixing pad 33 (urging member) which is provided along an inner surface 39 of the fixing belt 31 and urged to presses the fixing belt 31 towards the pressurizing roller 32.

The fixer 14 further includes a heat generating element 34 which is in contact with the inner surface 39 of the fixing belt 31, and generates heat due to the magnetic flux, and a magnetic flux shielding member 35.

Figure 3:
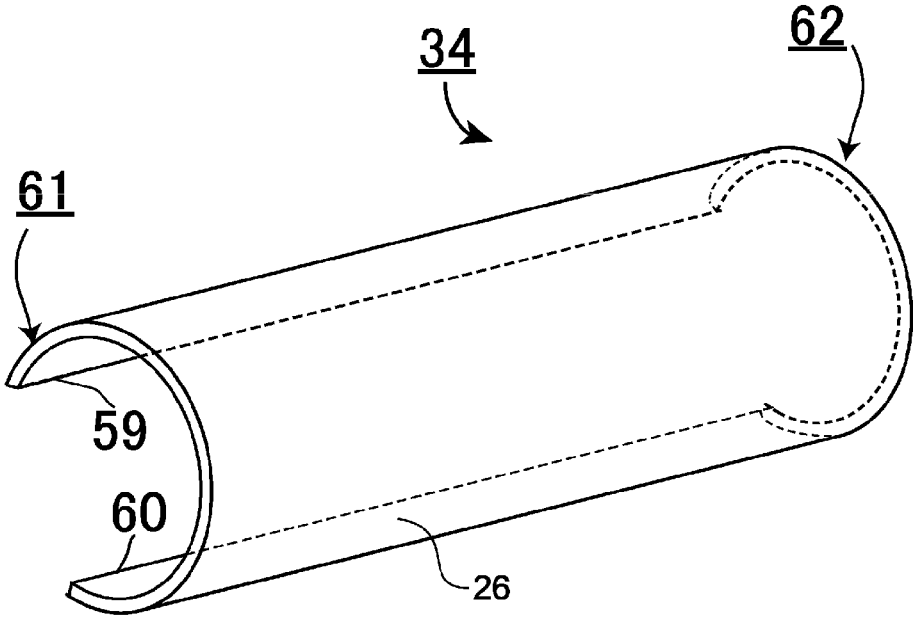
FIG. 3 is a perspective view of a heat generating element of the fixer according to the embodiment.
Figure 4:
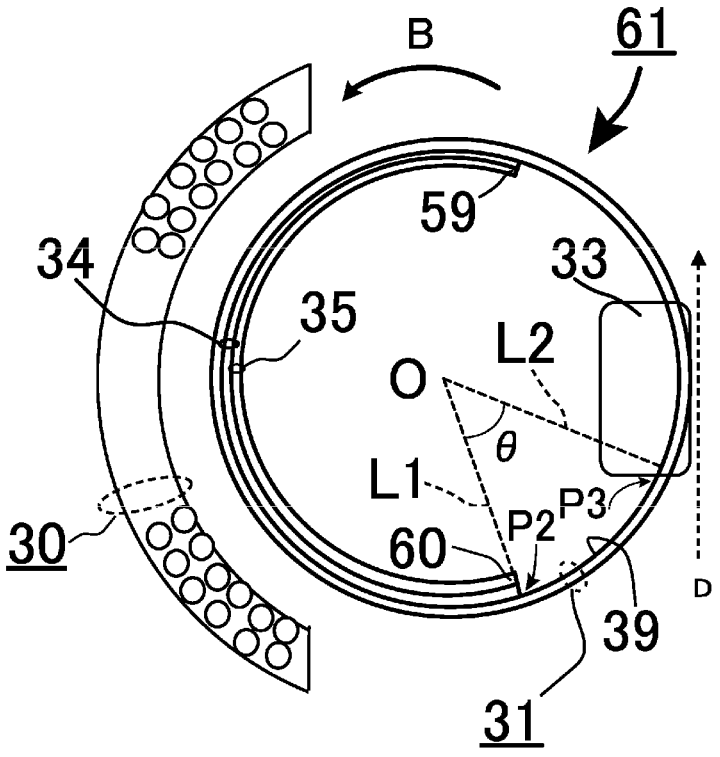
FIG. 4 illustrates a positional relationship between the heat generating element and an urging member of the fixer according to the embodiment.

FIG. 3 is a perspective view of the heat generating element 34. FIG. 4 illustrates a positional relationship between the heat generating element 34 and the fixing pad 33 on a plane. The heat generating element 34 includes a first end portion 59 and a second end portion 60 in a moving direction of the fixing belt 31. The heat generating element 34 also includes one end 61 and the other end 62 which are respectively open, in a belt width direction which intersects the moving direction of the fixing belt 31. The moving direction means a circumference direction of the fixing belt 31.

The first end portion 59 is located at a first position P1 downstream with respect to the fixing pad 33 in the moving direction, and the second end portion 60 is located at a second position P2 which is downstream with respect to the first position P1 in the moving direction.

An angle θ, which is formed by a first straight line L1 which connects a center O of a circular locus which is drawn when one end of the fixing belt 31 in the belt width direction moves in the moving direction B of the fixing belt 31 and the second end portion 60 (second position P2), and a second straight line L2 which connects the center O of the locus and a third position P3 at which the fixing pad 33 is in contact with the fixing belt 31, and which is downstream with respect to the second end portion 60 in the moving direction of the fixing belt 31, is equal to or smaller than 60°. The angle θ may be equal to or smaller than 40°.

The center means a center of a locus which is drawn when one end of the fixing belt 31 that extends in the belt width direction moves along with the revolving movement of the fixing belt 31.

Here, the center O, the first end portion 59, the second end portion 60, and a third end portion which is located at the third position P3 of the fixing pad 33 are on the same plane. The angle θ is a central angle of an arc which is formed by the center O, P2, and P3.

The straight line L1 connects the center O and P2 on the plane. The straight line L2 connects the center O and P3.

A shape of the other end 62 of the fixing belt 31 in the belt width direction is substantially the same as that of the one end 61.

The positions P1, P2, and P3 are inner circumferential positions of the fixing belt 31. All of the positions P1, P2, and P3 are on lines which are parallel to the belt width direction.

The second position P2 corresponds to a position at which the heat generating element 34 ends at a downstream side in the revolving moving direction (direction of arrow B) of the fixing belt 31. The downstream side denotes the downstream side with respect to the heat generating element 34.

The third position P3 corresponds to a position on the most upstream side of the fixing belt 31 in the revolving moving direction, at which an end portion of the fixing pad 33 is in contact with the inner surface 39. The upstream side denotes the upstream side with respect to the fixing pad 33.

The position P3 is on a line on which the fixing belt 31 and the fixing pad 33 start to come into contact with each other in a contact region between the fixing pad 33 and the fixing belt 31 when the fixing belt 31 moves.

The exciting coil 30 in FIG. 2 includes a linear member 40 and a ferrite core 51. The linear member 40 is wound around the ferrite core 51 along the width direction of the fixing belt 31. The linear member 40 generates a fluctuating magnetic field when an alternating current is supplied. The ferrite core 51 increases density of a magnetic flux. The fixer 14 includes an induction heating circuit 58 (FIG. 1) that is connected to the exciting coil 30. The induction heating circuit 58 supplies an alternating current to the exciting coil 30.

Figure 5:
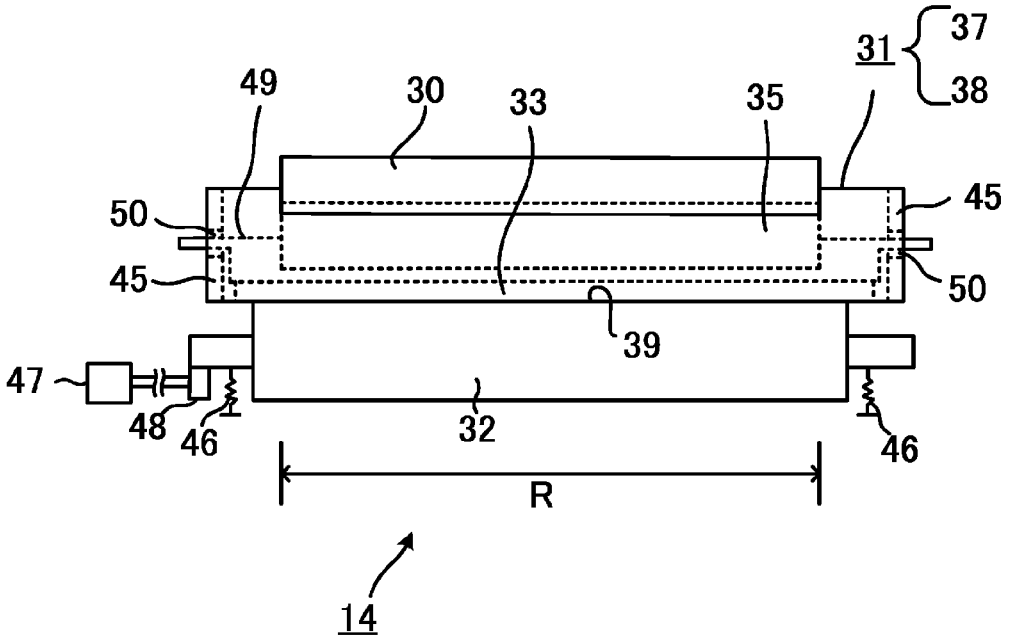
FIG. 5 is a top view of the fixer according to the embodiment.

FIG. 5 is a top view of the fixer 14. In the fixer 14, the exciting coil 30 is apart from the outer surface of the fixing belt 31 with a clearance therebetween.

The fixing belt 31 includes a flexible base material 37 which moves around a center of the revolving, and a Cu layer (metal layer) formed on the outer surface of the base material 37. The center of the revolving is parallel to a center of a bearing 50.

The Cu layer 38 partially generates heat in the width direction thereof. The Cu layer 38 generates heat in a region (hereinafter, referred to as partial region R) which faces the exciting coil 30 of the entire region of the outer surface of the fixing belt 31. A dimension of the partial region R in the width direction is substantially equal to a width of a sheet used in the image forming apparatus 10. The sheet width is a dimension which is orthogonal to the sheet transport direction.

Figure 6:
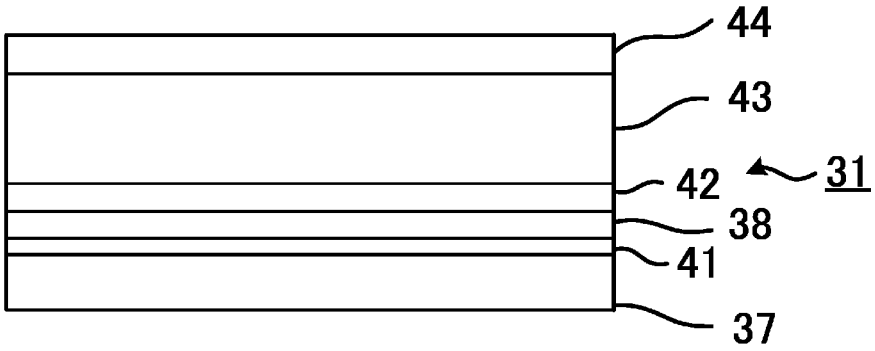
FIG. 6 illustrates a layer structure of a fixing belt of the fixer according to the embodiment.

FIG. 6 illustrates a layer structure of the fixing belt 31. The fixing belt 31 has a multilayered structure.

The fixing belt 31 includes a non-electrolytic Ni layer 41, the Cu layer 38 (metal layer), an electrolytic Ni layer 42, a heat resistant elastic layer 43, and a releasing layer 44 that are formed on the base material 37 in this order.

The base material 37 is a cylindrical body with a diameter of 30 mm and a thickness of 70 μm. The base material 37 is formed of a material having a heat-resisting property, such as, polyimide (PI).

The non-electrolytic Ni layer 41 is disposed on the outer surface of the base material 37, and has a thickness of 0.5 μm.

The Cu layer 38 is disposed on the outer surface of the non-electrolytic Ni layer 41. The Cu layer 38 is a heat generating layer having a resistance that is sufficient to generate heat. The Cu layer 38 generates heat using an electromagnetic induction caused by a magnetic field generated by the exciting coil 30. The thickness of the Cu layer 38 is 10 μm.

The electrolytic Ni layer 42 is present on the outer surface of the Cu layer 38. The electrolytic Ni layer 42 is a protective layer with a thickness of 8 μm.

The heat resistant elastic layer 43 is coated on the outer surface of the electrolytic Ni layer 42, with a thickness of 200 μm. The heat resistant elastic layer 43 may be made of a silicone (Si) rubber.

The releasing layer 44 covers the outer surface of the heat resistant elastic layer 43. The releasing layer 44 may be a perfluoroalkoxy alkanes (PFA) tube with a thickness of 30 μm.

In FIG. 2, the pressurizing roller 32 rotates in the direction of the arrow C. The pressurizing roller 32 is rotated by the fixing belt 31.

The pressurizing roller 32 may include a core metal member 28, an elastic layer 29 on the outer surface of the core metal member 28, and a releasing layer 36 on the outer surface of the elastic layer 29.

The core metal member 28 is an aluminum pipe, and an outer diameter thereof is 30 mm, hardness thereof is 65° (ASKER® TYPE with hardness C), and a thickness thereof is 3 mm. The elastic layer 29 is silicone sponge with a thickness of 8 mm. The releasing layer 36 is a PFA tube with a thickness of 30 μm.

In addition, the pressurizing roller 32 is longer than the exciting coil 30 in the belt width direction. The left end region and the right end region on the outer surface of the pressurizing roller 32 are in contact with the outer surface of the fixing belt 31 outside the partial region R of the fixing belt 31.

The fixer 14 may include two spring coils 46 in the pressurizing roller 32. The spring coil 46 applies to the pressurizing roller 32 a force urging toward the fixing belt 31.

The fixer 14 may include a motor 47. The motor 47 rotatably drives the pressurizing roller 32 through a gear 48.

The fixing pad 33 is provided in an inner circumferential region which is different from an inner circumferential region to which tension is applied from the heat generating element 34 to the fixing belt 31 in the whole circumferential region of the inner surface 39. The fixing belt 31 does not receive the tension from the heat generating element 34 in a range from the second position P2 to the first position P1.

The fixing pad 33 is provided between the first position P1 and the second position P2, and faces a nip region between the fixing belt 31 and the pressurizing roller 32. A center of fixing pad 33 in a height direction thereof may be located at a center of the first position P1 and the second position P2.

As illustrated in FIG. 5, a force which is applied from the fixing pad 33 to the inner surface 39 of the fixing belt 31 contributes to form the nip region between the fixing belt 31 and the pressurizing roller 32.

In the belt width direction, the fixing pad 33 is longer than the pressurizing roller 32. In the belt width direction, the fixing pad 33 is shorter than the fixing belt 31.

The fixer 14 may hold the fixing pad 33 in the fixing belt 31 using a stay 49. Each end of the stay 49 penetrates a flange 45 disposed in each end of the fixing belt 31. Each of the flanges 45 holds the stay 49 through the bearing 50. Each tip end of the stay 49 is fixed to a housing 52 (FIG. 1).

A material of the fixing pad 33 is a polyether ether keton resin (PEEK) or a heat-resistant phenol resin (PF).

As illustrated in FIG. 3, the heat generating element 34 has a shape which is similar to that of the inner surface 39 of the fixing belt 31.

The heat generating element 34 is a C-shaped cylindrical body which has a C-shape on one end face. The C-shape denotes that a part of a circular shape is lacked. The C-shaped cylindrical body is in contact with the inner surface 39 except for the lacked portion of which a central angle is equal to or less than 60°.

The heat generating element 34 has an outer surface 26, and the outer surface 26 extends along the cylindrical shape of the fixing belt 31 in the belt width direction, and curves along the inner surface 39 of the fixing belt 31.

The outer surface 26 is into contact with the inner surface 39 of the fixing belt 31. The heat generating element 34 faces the exciting coil 30 across the fixing belt 31.

In FIG. 4, the angle θ, which is formed by a line passing through the second position P2 of the heat generating element 34 and the center O and a line passing through the third position P3 and the center O is set to be in a range in which a crack is not produced during a use of the Cu layer 38.

In addition, the heat generating element 34 is formed of a metal material having temperature sensitive magnetism (temperature sensitive ferrite). Specifically, the heat generating element 34 is a magnetic shunt alloy.

The temperature sensitive ferrite has a magnetic property of being reversibly changed between ferromagnetism and nonmagnetism depending on a temperature range of the temperature sensitive ferrite (first temperature) which includes a fixing temperature.

The property of the heat generating element 34 is changed from ferromagnetism to nonmagnetism when the temperature of the temperature sensitive ferrite becomes higher than a temperature (second temperature) at which an amount of magnetic flux which penetrates the temperature sensitive ferrite is changed. The property of the heat generating element 34 is changed from nonmagnetism to ferromagnetism when the first temperature becomes lower than the second temperature. The fixer 14 adjusts the amount of heat generation according to the change of magnetism of the heat generating element 34.

In addition, the fixer 14 includes the magnetic flux shielding member 35 in the inside of the C-shaped cylindrical body of the heat generating element 34. In the fixer 14, the heat generating element 34 is disposed between the magnetic flux shielding member 35 and the fixing belt 31. The magnetic flux shielding member 35 urges the heat generating element 34 toward the fixing belt 31. Aluminum is used for the magnetic flux shielding member 35. The magnetic flux shielding member 35 prevents a noise caused by a magnetic flux around a sensor disposed in a space within the fixing belt 31.

In addition, the fixer 14 has a separation guide 27 downstream with respect to the fixing pad 33 in the sheet transport direction D. The fixer 14 separates a sheet from the fixing belt 31 using a tip end of the separation guide 27.

The fixer 14 includes a fixing belt thermistor 57 that detects a temperature based on which a magnetic flux of the exciting coil 30 is controlled. An output signal of the fixing belt thermistor 57 is sent to the induction heating circuit 58.

Subsequently, operations of an image forming apparatus according to the embodiment with the above described configuration will be described.

The fixer 14 starts a warming-up process in response to turning on the MFP 10 (FIG. 1) or transition of operational modes.

The pressurizing roller 32 pressurizes the fixing belt 31 towards the fixing pad 33, being urged by the spring coils 46. The pressurizing roller 32 rotates in the direction of the arrow C according to driving of the motor 47 through the gear 48. The fixing belt 31 is rotated in the direction of the arrow D in accordance with the pressurizing roller 32.

In the MFP 10 (FIG. 1), the photosensitive drum 22 of the yellow station 16Y rotates in the direction of the arrow J. The outer surface of the photosensitive drum. 22 is charged by the charger 23. The exposure unit 18 radiates laser light towards the charged photosensitive drum 22.

An electrostatic latent image is formed on the outer surface of the photosensitive drum 22 due to the exposure. The developing unit 24 develops the electrostatic latent image with yellow toner. Thus, the developing unit 24 visualizes the electrostatic latent image on the photosensitive drum 22 with yellow toner.

The toner image is conveyed on the photosensitive drum 22 as it rotates. In a transfer region of the yellow station 16Y, the primary transfer roller 19 applies a bias voltage to the intermediate transfer belt 17. The yellow station 16Y primarily transfers the yellow toner image onto the intermediate transfer belt 17 through an operation of the bias voltage.

Toner which remains on the photosensitive drum 22 without being transferred is removed by the photoreceptor cleaner 25. The photosensitive drum 22 is charged by the charger 23 again when rotating. The yellow station 16Y repeats the operation from charging to the primary transfer.

The magenta station 16M visualizes an electrostatic latent image with magenta toner by performing the same operation as that performed by the yellow station 16Y. The cyan station 16C visualizes an electrostatic latent image with a cyan toner. The black station 16K visualizes an electrostatic latent image with a black toner.

A portion of the intermediate transfer belt 17 on which the yellow toner image is formed is transferred to a transfer region of the magenta station 16M. At the magenta station 16M, the magenta toner image is transferred to the portion of the intermediate transfer belt 17 on which the yellow toner image is formed.

The portion of the intermediate transfer belt 17 sequentially conveyed to each transfer region of the cyan station 16C and the black station 16K. At the cyan station 16C and the black station 16K, the cyan toner image and the black toner image are transferred to the portion of the intermediate transfer belt 17, respectively.

On the other hand, the sheet feeding unit 12 picks up a sheet using a pair of pickup rollers 54 and a plurality of pair of transport rollers 55. The sheet feeding unit 12 transports the sheet to a secondary transfer region in synchronization with formation of toner images of four colors using a pair of resist rollers 56.

The secondary transfer region denotes a space which is formed at the intermediate transfer belt 17, the secondary transfer roller 20, and the counter roller 21.

The secondary transfer roller 20 secondarily transfers the toner images on the intermediate transfer belt 17 onto the sheet by applying a bias current to the sheet. The secondary transfer roller 20 transfers the toner images of yellow, magenta, cyan, and black which are formed on the intermediate transfer belt 17 to the sheet.

A controller 15 respectively controls pickup timing of the sheet, timing of supplying the sheet to the printing unit 13, timing of the primary transfer, and timing of the secondary transfer.

Subsequently, the secondary transfer roller 20 transports the sheet on which the toner images of each color are transferred, to the fixer 14.

The pressurizing roller 32 causes a force to work between the pressurizing roller 32 and the fixing pad 33. The pressurizing roller 32 applies a weight of approximately 350 N, being urged by the spring coils 46, through the fixing belt 31. A nip of 6.0 mm in the sheet transport direction is formed between the pressurizing roller 32 and the fixing belt 31.

The fixer 14 causes toner to be melted while applying heat and a pressure to the sheet. The fixer 14 causes toner of each color to be fixed.

A cleaner (not illustrated) cleans toner remaining on the intermediate transfer belt 17 without being transferred.

As described above, an example of printing an image on one sheet using the MFP 10 is described.

Regarding the fixer 14, in FIG. 2, the exciting coil 30 generates a magnetic flux in accordance with a high frequency current applied thereto. The magnetic flux causes an eddy current in the Cu layer 38 of the fixing belt 31. The Cu layer 38 generates Joule heat as the eddy current flows through the Cu layer 38 having a resistance. Thus, the fixing belt 31 with the Cu layer 38 can generate heat using the electromagnetic induction heating with the exciting coil 30.

The fixer 14 includes the fixing belt thermistor 57 that is disposed on and in contact with the inner surface 39 of the fixing belt 31. The fixing belt thermistor 57 detects a temperature at the inner surface 39 of the fixing belt 31. The fixer 14 controls the temperature of the fixing belt 31 to be 150° C. to 160° C.

The heat generating element 34 generates heat by being electromagnetically induced by the magnetic field which is generated by the exciting coil 30. The metal material having the temperature sensitive magnetism, which is used in the heat generating element 34, has a property that reversibly transitions between ferromagnetism and nonmagnetism. The metal material having the temperature sensitive magnetism has a Curie point.

Relative permeability of the metal material having the temperature sensitive magnetism in a low temperature range rises as the temperature of the metal material rises. The relative permeability substantially decreases to zero when the temperature of the metal material exceeds the Curie point.

FIG. 7 is a chart illustrating a relationship between a central angle θ of the arc (i.e., lacked portion of the heat generating element 34) on one end plane of the heat generating element 34 and life duration of the fixing belt 31.

The life duration of the fixing belt 31 is an experimental result of durability of the fixing belt 31. The figure in the right column of FIG. 7 denotes the number of sheets which have passed through the fixing belt 31 until a crack is generated in the fixing belt 31. In the experiment, a process of conveying a plain sheet to the fixer 14, pressurizing and heating the sheet by the fixer 14, and discharging the sheet is continuously repeated.

In an experiment in which the fixer 14 having the heat generating element 34 with a central angle of θ which is equal to or less than 60° is used, a crack was not produced in the Cu layer 38 even when the number of sheets exceeds 200 k (200,000).

In an experiment in which the fixer 14 having the heat generating element 34 with a central angle of θ which exceeds 60° is used, a crack was produced in the Cu layer 38 before the number of sheets reached 200 k.

A cracked portion of the Cu layer 38 does not generate sufficient heat. The insufficient heat at the cracked portion may cause a partial fixing failure.

In addition, abnormal heating may occur at the periphery of the cracked portion of the Cu layer 38. When the heat generating element 34 which causes the abnormal heating is continuously used, the Si rubber layer (heat resistant elastic layer 43) and the PI base material (base material 37) of the fixing belt 31 may be damaged.

In the fixer and the image forming apparatus according to the embodiment in which the central angle θ is 40°, the fixing belt 31 was not damaged even when sheets of 200 k have passed.

That is, the angle θ which is formed with a face passing through the second position P2 of the heat generating element 34 and the center O of the locus and a face passing through the third position P3 and the center O of the locus is 40°. As the fixing belt 31 is not damaged, life duration of the fixing belt 31 is longer.

When a fixing belt 31 of which angle θ is 20° was used, the fixing belt 31 was not damaged even when sheets of 200 k have passed. When a fixing belt 31 of which angle θ is 60° was used, the fixing belt 31 was not damaged even when sheets of 200 k have passed.

In the fixer and the image forming apparatus according to the embodiment, when the central angle θ was equal to or less than 60°, the fixing belt 31 was not damaged even when sheets of 200 k have passed. When target life duration of the fixing belt 31 is set to the point when 200 k of sheets are passed, it is possible to achieve the target life duration.

Accordingly, a crack is unlikely to be produced in the Cu layer 38 when using the fixing belt 31. The fixing belt 31 is not excessively heated, and is not damaged.

Given these examples, the fixer 14 includes the fixing belt 31 (fixing member) which includes a metal layer and revolves, and the pressurizing roller 32 (pressurizing member) which is disposed with being in contact with the inner surface of the fixing belt 31 and is rotatably driven through the fixing belt 31. The fixer 14 includes the fixing pad 33 (pressing member) which contributes to form a nip by being in contact with the pressurizing roller 32, and the heat generating element 34 which is in contact with the inner surface 39 along the circumferential direction. An angle which is formed with a position at which heat generating element 34 ends and a position at which the fixing pad 33 starts to be in contact with the fixing belt 31 in the revolving direction is equal to or less than 60°.

In the above descriptions, the fixer 14 may be variously modified.

A pressurizing member other than the pressurizing roller 32 may be used. An urging member other than the fixing pad 33 may be used.

A contact area between the outer surface 26 and the inner surface 39 is predetermined according to a capacity of generated heat.

The angle θ may be denoted by rad.

The ASKER® TYPE C indicates hardness which is calculated using a durometer which is manufactured complying with a standard of Japanese Industrial Standards (JIS) K7312, or a standard of Society of Rubber Industry, Japan (SRIS) 0101.

The image forming apparatus according to the embodiment is a tandem system; however, the image forming apparatus may be a rotating type, for example. The image forming apparatus according to the embodiment may directly transfer a toner image to a sheet from the photosensitive drum 22.

It is sufficient for the fixing belt 31 in FIG. 2 to include the Cu layer 38, which is a heat generating layer. The fixing belt 31 may overlap the releasing layer 44 with the surface of the Cu layer 38. The heat generating element 34 may have a plurality of slits. The heat generating element 34 may have a plurality of sub-heating elements which are divided in the belt width direction.

The metal layer is the Cu layer 38; however, Fe or Ni may be used in the metal layer.

The electrolytic Ni layer 42 is provided on the Cu layer 38; however, a separate Cu layer may be provided on the electrolytic Ni layer 42.

The position of the fixing belt thermistor 57 is an example, and can be changed. Superiority of the image forming apparatus and the fixer according to the embodiment will not change even when these modifications are executed.

A temperature can be denoted using either Celsius or Fahrenheit.

Although exemplary embodiments of the present invention have been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. A fixer comprising:

a fixing belt configured to move around a center;

a heating unit configured to induction-heat the fixing belt;

a pressing member that presses an outer surface of the fixing belt;

a resilient member disposed opposite to the pressing member across the fixing belt; and a heat generating member that is capable of being induction-heated and disposed along the inner surface of the fixing belt between a first position and a second position that is downstream with respect to the first position in a moving direction of the fixing belt, wherein an upstream end portion of the resilient member in the moving direction is in contact with a third position of the fixing belt, and an angle formed with respect to the center by the second and third positions is equal to or smaller than 60°.

2. The fixer according to claim 1, wherein the angle is equal to or smaller than 40°.

3. The fixer according to claim 1, wherein the fixing belt includes a metal layer that is capable of being induction-heated.

4. The fixer according to claim 1, wherein the heat generating member has a nonmagnetic property or a ferromagnetic property depending on a temperature thereof.

5. The fixer according to claim 1, wherein an entire outer surface of the heat generating member is in contact with the fixing belt.

6. The fixer according to claim 1, wherein the heat generating member is formed in an arc shape.

7. The fixer according to claim 1, further comprising:

a magnetic flux shielding member disposed along an inner surface of the heat generating member between the first position and the second position.

8. An image forming apparatus comprising:

an image forming unit configured to form a toner image on a sheet; and a fixing unit configured to fix the toner image on the sheet, the fixing unit including, a fixing belt configured to move around a center;

a heating unit configured to induction-heat the fixing belt, a pressing member that presses an outer surface of the fixing belt, a resilient member disposed opposite to the pressing member across the fixing belt and urged towards an inner surface of the fixing belt, and a heat generating member that is capable of being induction-heated and disposed along the inner surface of the fixing belt between a first position and a second position that is downstream with respect to the first position in a moving direction of the fixing belt, wherein an upstream end portion of the resilient member in the moving direction is in contact with a third position of the fixing belt, and an angle formed with respect to the center by the second and third positions is equal to or smaller than 60°.

9. The image forming apparatus according to claim 8, wherein the angle is equal to or smaller than 40°.

10. The image forming apparatus according to claim 8, wherein the fixing belt includes a metal layer that is capable of being induction-heated.

11. The image forming apparatus according to claim 8, wherein the heat generating member has a nonmagnetic property or a ferromagnetic property depending on a temperature thereof.

12. The image forming apparatus according to claim 8, wherein an entire outer surface of the heat generating member is in contact with the fixing belt.

13. The image forming apparatus according to claim 8, wherein the heat generating member is formed in an arc shape.

14. The image forming apparatus according to claim 8, further comprising:

a magnetic flux shielding member disposed along an inner surface of the heat generating member between the first position and the second position.

15. A fixer comprising:

an endless belt configured to move around a center;

an induction heater for the endless belt;

a resilient member disposed along an inner surface of a first portion of the endless belt;

a pressing member configured to press an outer surface of the endless belt against the resilient member to form a nip between the pressing member and the outer surface of the endless belt; and a heat generating member configured to generate heat in response to the induction heater, and arranged along an inner surface of a second portion of the endless belt that is different from the first portion and separated from the first portion, wherein an angle formed with respect to the center by a downstream end of the heat generating member and an upstream end of the first portion, in a moving direction of the endless belt, is equal to or smaller than 60°.

16. The fixer according to claim 15, wherein the endless belt includes a metal layer that generates heat in response to the induction heater.

17. The fixer according to claim 15, wherein the heat generating member has a nonmagnetic property or a ferromagnetic property depending on a temperature thereof.

18. The fixer according to claim 15, wherein an entire outer surface of the heat generating member is in contact with the endless belt.

19. The fixer according to claim 15, wherein the heat generating member is formed in an arc shape.

20. The fixer according to claim 15, further comprising:

a magnetic flux shielding member disposed along an inner surface of the heat generating member.

* * * * *